US010058878B2

(12) United States Patent
Hu et al.

(10) Patent No.: US 10,058,878 B2
(45) Date of Patent: Aug. 28, 2018

(54) SHOWER HEAD WITH DUAL SWITCHES

(71) Applicant: Xiamen Runner Industrial Corporation, Xiamen (CN)

(72) Inventors: Xin-Zhan Hu, Xiamen (CN); Wen Gao, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 0 days.

(21) Appl. No.: 15/660,951

(22) Filed: Jul. 27, 2017

(65) Prior Publication Data

US 2018/0029049 A1 Feb. 1, 2018

(30) Foreign Application Priority Data

Jul. 28, 2016 (CN) ..... 2016 1 0603794

(51) Int. Cl.

| | |
|---|---|
| ***B05B 1/00*** | (2006.01) |
| ***B05B 1/16*** | (2006.01) |
| ***B05B 1/18*** | (2006.01) |
| ***B05B 1/30*** | (2006.01) |
| *B05B 12/00* | (2018.01) |

(52) U.S. Cl.

CPC ..... *B05B 1/1645* (2013.01); *B05B 1/1636* (2013.01); *B05B 1/18* (2013.01); *B05B 1/3013* (2013.01); *B05B 1/3026* (2013.01); *B05B 12/002* (2013.01)

(58) Field of Classification Search

CPC ..... B05B 1/1609; B05B 1/1636; B05B 1/185; B05B 1/30; B05B 1/3026; B05B 1/3033; B05B 1/16; B05B 1/1627; B05B 1/1663

USPC ..... 239/436–499

See application file for complete search history.

(56) References Cited

U.S. PATENT DOCUMENTS

| | | | | |
|---|---|---|---|---|
| 4,143,821 A * | 3/1979 | Aghnides | B05B 1/083 | 239/381 |
| 4,191,332 A * | 3/1980 | De Langis | B05B 1/3026 | 239/428.5 |
| 4,193,553 A * | 3/1980 | Kelly | B05B 1/3013 | 239/525 |
| 4,921,002 A * | 5/1990 | Christon | A01G 25/162 | 137/119.03 |
| 5,145,114 A * | 9/1992 | Monch | B05B 1/1618 | 239/126 |

(Continued)

*Primary Examiner* — Viet Le

(74) *Attorney, Agent, or Firm* — Chun-Ming Shih

(57) ABSTRACT

A shower head includes a body provided with a waterway. A first switch is movably mounted on the body to be responsible for selectively opening and closing the waterway and a second switch movably mounted on the body to be responsible for selectively changing water output patterns. The first switch has a rear pushbutton, a driving rod movably connected to the rear pushbutton and a diverting element movable relative to the body to be responsible for closing or opening the waterway. The second switch has a front pushbutton, a sliding element having a rack formed on a face thereof, a diverter rotatably received inside the body, a gear rotatably received inside the body and having first ratchet teeth and a rotor having second ratchet teeth selectively engaged with the first ratchet teeth to allow the rotation of the gear to drive the second ratchet teeth of the rotor to disengage with the first ratchet teeth of the gear as well as the rotor and the diverter to rotate accordingly.

12 Claims, 7 Drawing Sheets

(56) References Cited

U.S. PATENT DOCUMENTS 5,383,604 A * 1/1995 Boesch ..... B05B 1/1618 239/447
5,433,384 A * 7/1995 Chan ..... B05B 1/1636 239/239
5,577,664 A * 11/1996 Heitzman ..... B05B 1/1636 239/99
5,653,260 A * 8/1997 Huber ..... E03C 1/021 137/625.33
5,727,591 A * 3/1998 Doll ..... F16K 31/105 137/554
5,772,120 A * 6/1998 Huber ..... B05B 1/1618 239/391
5,819,789 A * 10/1998 Schneider ..... F16K 3/08 137/454.5
5,871,296 A * 2/1999 Furukawa ..... B43K 5/1881 401/106
6,233,758 B1 * 5/2001 Jeong ..... B05B 1/302 137/39
6,367,710 B2 * 4/2002 Fan ..... B05B 1/1636 239/381
6,370,713 B2 * 4/2002 Bosio ..... B05B 1/1618 4/677
6,612,507 B1 * 9/2003 Meyer ..... A46B 11/06 239/390
6,738,996 B1 * 5/2004 Malek ..... B05B 1/1618 239/441
6,755,204 B2 * 6/2004 Herbert ..... F16K 11/166 137/1
7,070,125 B2 * 7/2006 Williams ..... B05B 1/1618 239/443
7,341,239 B2 * 3/2008 Hodel ..... F16K 31/52416 137/872
7,494,074 B2 * 2/2009 Benstead ..... B05B 1/1618 239/11
7,871,020 B2 * 1/2011 Nelson ..... E03C 1/0404 137/801
7,909,269 B2 * 3/2011 Erickson ..... B05B 1/1618 137/801
8,070,076 B2 * 12/2011 Erickson ..... E03C 1/0404 239/279
8,113,442 B2 * 2/2012 Li ..... B05B 1/18 239/11
8,448,667 B2 * 5/2013 Meehan ..... E03C 1/0404 137/637.1
9,022,057 B2 * 5/2015 Zink ..... B05B 12/04 137/240
9,199,252 B2 * 12/2015 Schorn ..... B05B 1/16
9,387,495 B2 * 7/2016 Schumacher ..... B05B 1/30
9,427,749 B2 * 8/2016 Zhou ..... B05B 1/1636
9,470,334 B2 * 10/2016 Zhou ..... F16K 31/44
9,616,434 B2 * 4/2017 Pan ..... B05B 1/1636
9,707,572 B2 * 7/2017 Erickson ..... B05B 1/1618
9,714,502 B2 * 7/2017 Huang ..... F16K 11/074
9,776,196 B2 * 10/2017 Yu ..... B05B 1/1636
9,829,116 B2 * 11/2017 Xu ..... F16K 31/535
9,901,939 B2 * 2/2018 Lin ..... B05B 1/185
2005/0258274 A1 * 11/2005 Wang ..... B05B 1/1636 239/393
2006/0219822 A1 * 10/2006 Miller ..... B05B 1/30 239/562
2007/0194148 A1 * 8/2007 Rosko ..... B05B 1/1609 239/526
2008/0023577 A1 * 1/2008 Zhen ..... B05B 1/1618 239/449
2008/0105764 A1 * 5/2008 Jianglin ..... B05B 1/1618 239/526
2008/0245897 A1 * 10/2008 Nobili ..... E03C 1/0409 239/407
2009/0127353 A1 * 5/2009 Meisner ..... B05B 1/1645 239/394
2009/0194613 A1 * 8/2009 Mang ..... B05B 1/18 239/562
2009/0288250 A1 * 11/2009 Zhou ..... B05B 1/1636 4/615
2010/0148104 A1 * 6/2010 Ho-Yeong ..... E03C 1/055 251/209
2010/0264237 A1 * 10/2010 Engel ..... B05B 1/1654 239/443
2010/0320295 A1 * 12/2010 Mang ..... B05B 1/18 239/562
2011/0024516 A1 * 2/2011 Li ..... B05B 1/1636 239/11
2012/0259282 A1 * 10/2012 Alderete, Jr. ..... A61M 5/14244 604/131
2012/0305116 A1 * 12/2012 Zhou ..... B05B 1/1636 137/625.46
2013/0247294 A1 * 9/2013 Zhou ..... B05B 1/1636 4/615
2013/0284823 A1 * 10/2013 Zhou ..... B05B 1/18 239/438
2014/0182691 A1 * 7/2014 James ..... F16K 11/078 137/3
2015/0224519 A1 * 8/2015 Buhler ..... B05B 1/18 239/443
2016/0167062 A1 * 6/2016 Pan ..... B05B 1/1636 239/442
2016/0221006 A1 * 8/2016 Lin ..... B05B 1/1636
2016/0310972 A1 * 10/2016 Lin ..... B05B 1/1636
2016/0325291 A1 * 11/2016 Zhou ..... B05B 1/18
2017/0056897 A1 * 3/2017 Xu ..... F16K 31/535
2017/0100727 A1 * 4/2017 Lin ..... B05B 1/1636
2017/0100728 A1 * 4/2017 Gong ..... B05B 1/1636
2017/0136473 A1 * 5/2017 Yu ..... B05B 1/1636
2017/0173603 A1 * 6/2017 Lin ..... B05B 1/1663
2017/0182503 A1 * 6/2017 Moehring ..... B05B 1/1636
2018/0029049 A1 * 2/2018 Hu ..... B05B 1/1645
2018/0051816 A1 * 2/2018 Lin ..... F16K 11/078

* cited by examiner

SHOWER HEAD WITH DUAL SWITCHES

CROSS REFERENCE

This application claims the priority of Chinese Application No. 201610603794.X, filed on Jul. 28, 2016 and the entirety thereof is herein incorporated with reference.

TECHNICAL FIELD

The preferred embodiment of the present invention is related to the field of a shower head and, more particularly, to a shower head with dual switches to allow the user to single-handed operate the water output pattern as well as water output.

BACKGROUND OF THE INVENTION

Normally, a shower head provided inside the shower room allows the user to take a shower via a single switch to determine water output. If the user wants to change the water output pattern, the user will have to first remove the shower head from the shower seat and then manually rotate the diverter on the shower head to accomplish the objective. Even though, there are various diverters available on the market to allow the user to change the water output pattern, still, user's manual operation on the diverter is still necessary.

In order to obviate or mitigate the aforementioned problem, the preferred embodiment of the present invention is to provide a shower head with dual switches to allow the user to single-handed operate the water output as well as water output pattern.

SUMMARY OF THE INVENTION

It is an objective of the preferred embodiment of the present invention to provide a shower head having two switches to allow the user to operate the water output with one switch and water output pattern with the other switch.

In order to accomplish the abovementioned objective, the shower head constructed in accordance with the present invention includes a body having therein a waterway, a first switch installed on the body to control water output and a second switch to control water output pattern. With such a design, the operator (user) is able to operate the shower head with one hand to control the water output as well as water output pattern.

Still another objective of the preferred embodiment of the present invention is that the first switch is a mechanical, dual-position switch.

Still another objective of the preferred embodiment of the present invention is that the second switch is a mechanical switch with multiple positions.

Furthermore, the second switch of the shower head of the preferred embodiment of the present invention has a front pushbutton hinged to a surface of the body, a rocker operably connected to the front pushbutton, a sliding element one end of which is securely engaged with the rocker so that the sliding element is driven by the rocker to move linearly and the other end of which is provided with a rack formed on a face of the sliding element, a diverter rotatably mounted inside the body and having a shaft integrally extending out from a side face of the diverter, a gear rotatably mounted around the shaft and a rotor securely mounted on the shaft and having wolf teeth formed on a surface thereof to match with slanted teeth formed on a face of the gear such that when the rotor is rotated along with the shaft of the diverter in one direction, the gear is also rotated and when the rotor is rotated along with the shaft of the diverter is the other direction, only the rotor is rotated, but not the gear. A first recoil spring is provided between an inner face of the body and a side face of the rotor to securely abut the rotor against the gear to ensure that the wolf teeth is mated with the slanted teeth on the face of the gear.

Still another objective of the preferred embodiment of the present invention is that the first switch includes a rear pushbutton, a driving rod having a first ratchet teeth formed on a side face thereof, a diverting element having a rod extending into a central through hole defined in the driving rod and a second ratchet teeth formed on a side face thereof to mate with the first ratchet teeth of the driving rod and a second recoil spring provided between the inner surface of the body and a side face of the diverting element to secure that the first ratchet teeth engages with the second ratchet teeth of the driving rod.

Furthermore, a still objective of the preferred embodiment of the present invention is that the first switch and the second switch may be adjacent to one another.

A further objective of the preferred embodiment of the present invention is that a third recoil spring is provided between the side face of the body and the sliding element to return the sliding element to its original position after movement.

DETAILED DESCRIPTION OF THE PREFERRED EMBODIMENT

Preferred embodiment(s) of the present invention in combination with the attached drawings shall be provided in detail in the following description. However, the given description is for example purpose only and should not be deemed as a limiting to the scope of the present invention in any way.

In order to make it easy to carry out the preferred embodiment of the present invention, a detailed description of the parts of the invention, supported with figures is provided here. As each part of the preferred embodiment of the present invention has many features, it is made easy to read, by referring to each feature with a number included in the parts description text. The number of the parts feature(s) is indicated here by starting it sequentially from the number 1, wherever a part feature appears in a text, an associated serial number is directly assigned.

Figure 1:
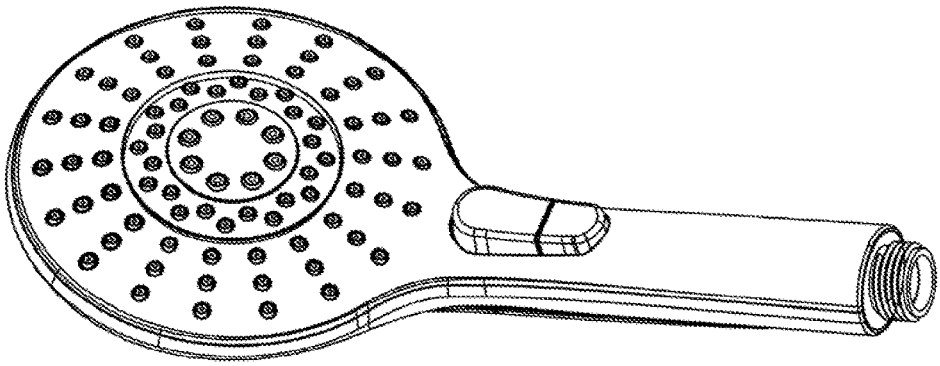
FIG. 1 is a perspective view of the shower head of the preferred embodiment of the present invention.
Figure 2:
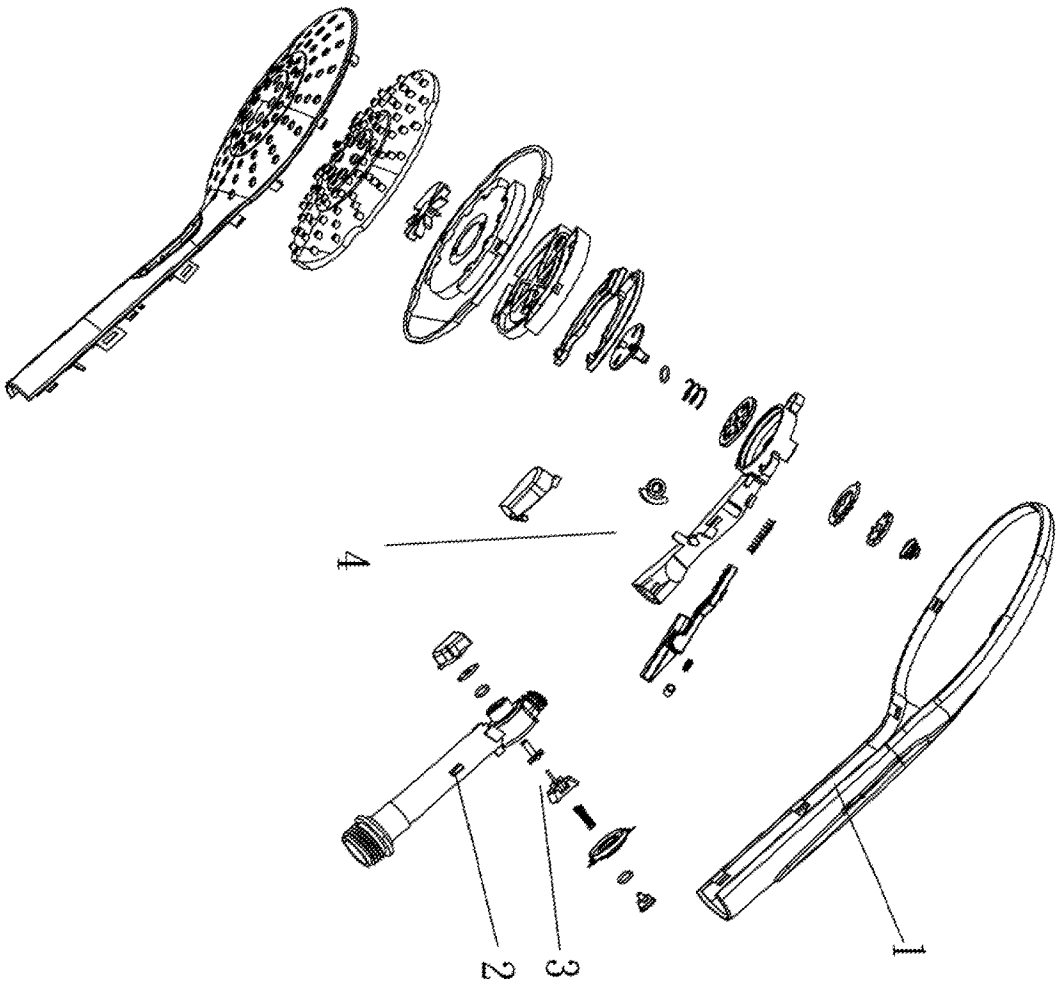
FIG. 2 is an exploded perspective view of the shower head shown in FIG. 1.

With reference to FIGS. 1 and 2, the shower head constructed in accordance with the preferred embodiment of the present invention includes a body 1, a waterway 2 defined inside the body 1, a first switch 3 installed on the body 1 to control water output and a second switch 4 to control water output pattern.

Figure 3:
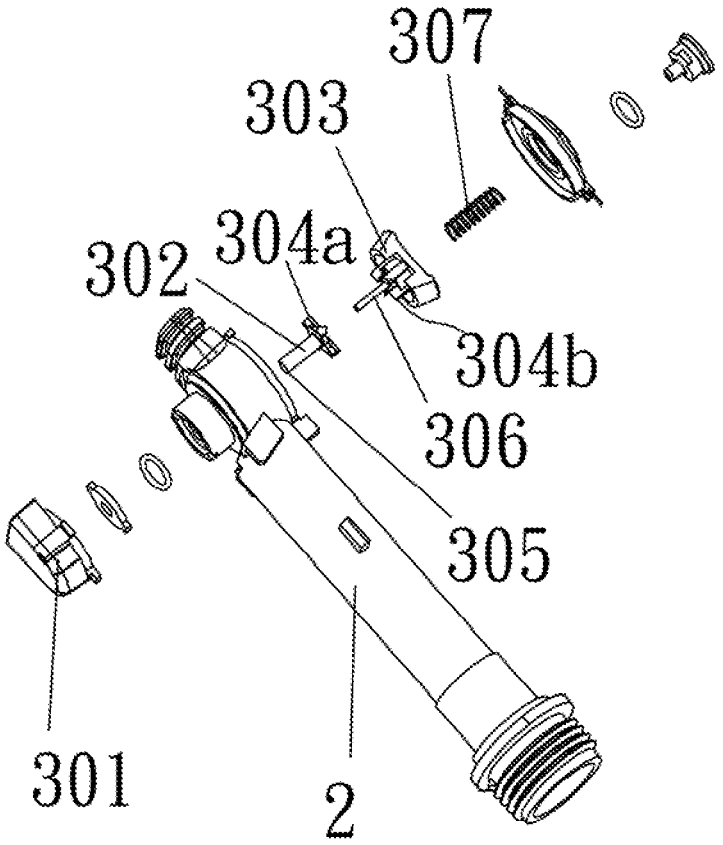
FIG. 3 is an exploded perspective view of a first switch installed on the body of the shower head of the preferred embodiment of the present invention.
Figure 4:
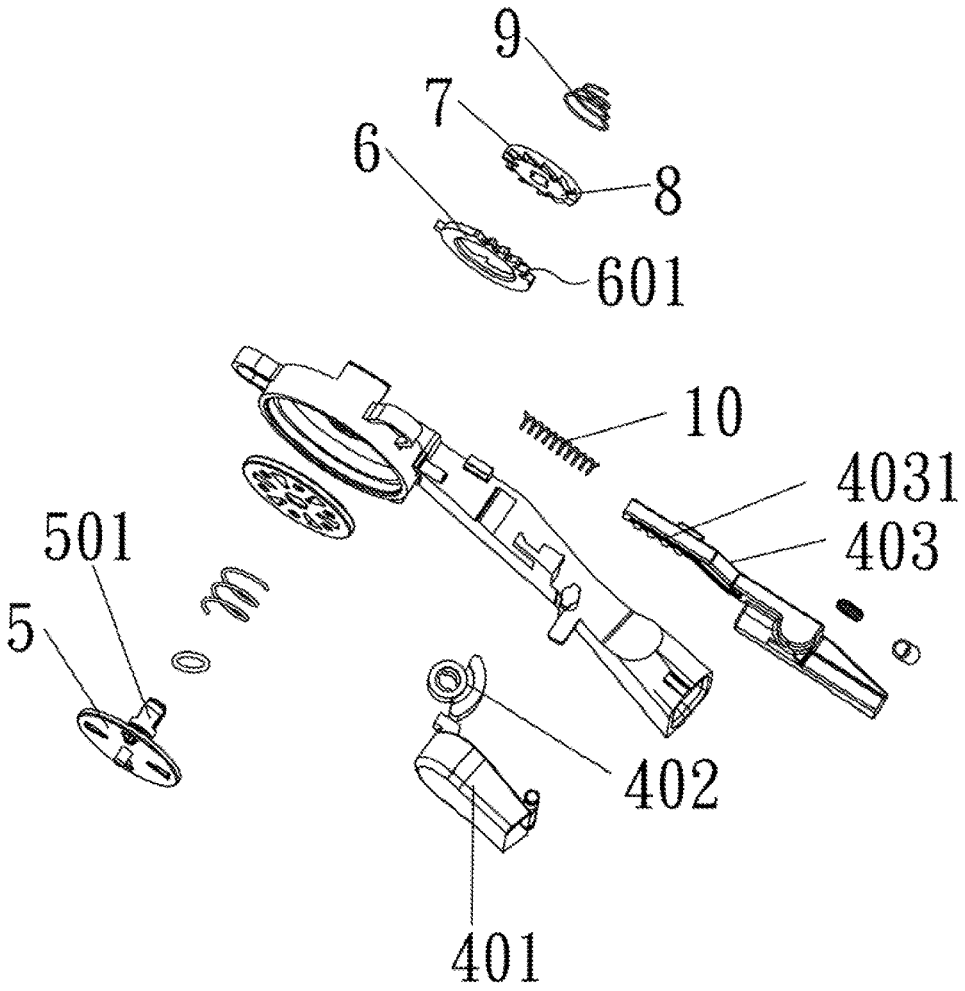
FIG. 4 is an exploded perspective view of a second switch installed on the body of the shower head of the preferred embodiment of the present invention.

With reference to FIGS. 3 and 4, it is to be noted that the first switch 3 includes a rear pushbutton 301 movably mounted on a side face of the body 1, a driving rod 302 axially movable relative to the body 1 and a first distal end of which is securely connected to the rear pushbutton 301 and a second distal end of which is provided with a first ratchet teeth 304*a*, a diverting element 303 having a rod 306 integrally extending away from the diverting element and into a central through hole 305 defined in the driving rod 302 and provided with a second ratchet teeth 304*b* formed on a side face thereof to match the first ratchet teeth 304*a* and a first recoil spring 307 provided to abut a side face of the diverting element 303 and an inner face of the body 1 to provide a recoil force to the diverting element 303 after movement.

The second switch 4 is composed of a front pushbutton 401 hinged onto the body to allow the rear pushbutton 401 to pivot relative to the body 1, a rocker 402 an end of which is securely connected to a distal end of the rear pushbutton 401, a sliding element 403 linearly movable inside the body 1 and provided with a rack 4031 formed on a side face thereof, a diverter 5 rotatably received inside the body 1 for diverting water into different output holes defined in the diverter 5 to form various output patterns and having a shaft 501 integrally extending out from a side face of the diverter 5, a gear 6 rotatably mounted around the shaft 501 and a rotor 7 securely mounted on the shaft 501 and being immovable relative to the diverter 5 and having wolf teeth 8 formed on a surface thereof to match with slanted teeth 601 formed on a face of the gear 6 such that when the rotor 7 is rotated along with the shaft 501 of the diverter 5 in one direction, the gear 6 is also rotated and when the rotor 7 is rotated along with the shaft 501 of the diverter 5 is the other direction, only the rotor 7 is rotated, but the gear 6. A second recoil spring 9 is provided between an inner face of the body 1 and a side face of the rotor 7 to securely abut the rotor 7 against the gear 6 to ensure that the wolf teeth 8 is mated with the slanted teeth 601 on the face of the gear 6. Furthermore, a recoil spring 10 is provided between a distal end of the sliding element 403 and the inner side face of the body to provide a recoil force to the sliding element 403 to return to its original position after movement.

Figure 5:
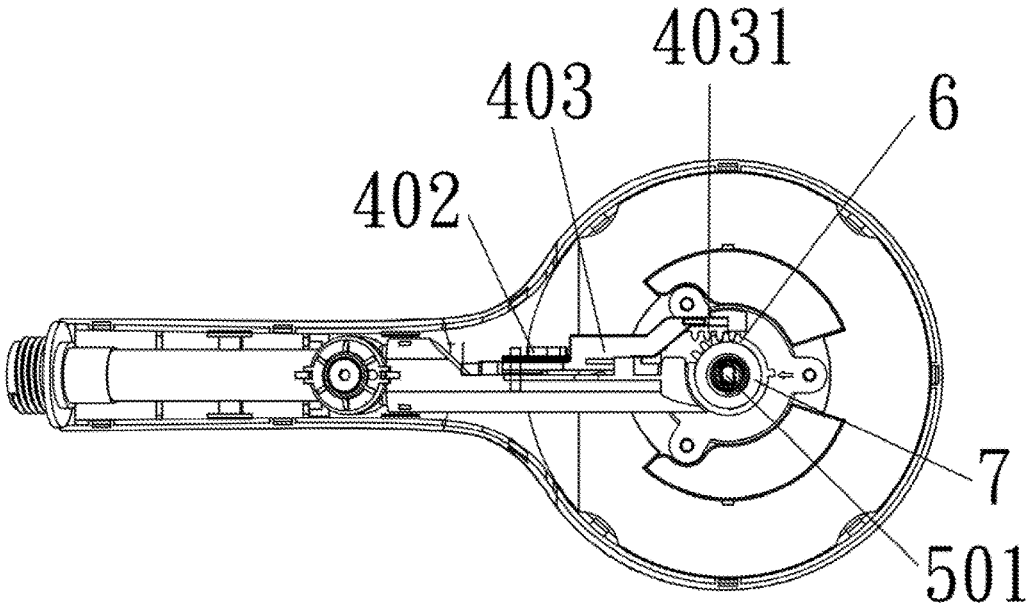
FIG. 5 is a plan view showing relationship among the second switch, the gear and the rotor.
Figure 6:
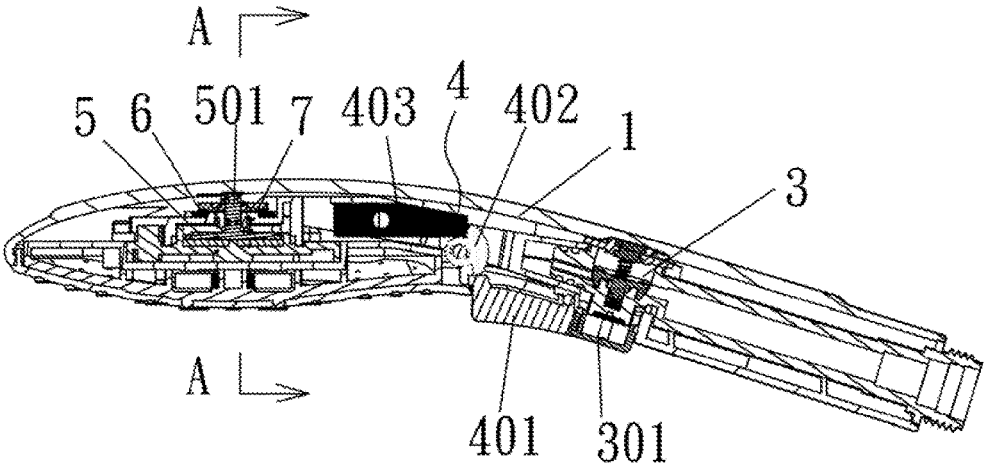
FIG. 6 is a schematic cross sectional view showing relationship among the second switch, the diverter, the gear and the rotor.
Figure 7:
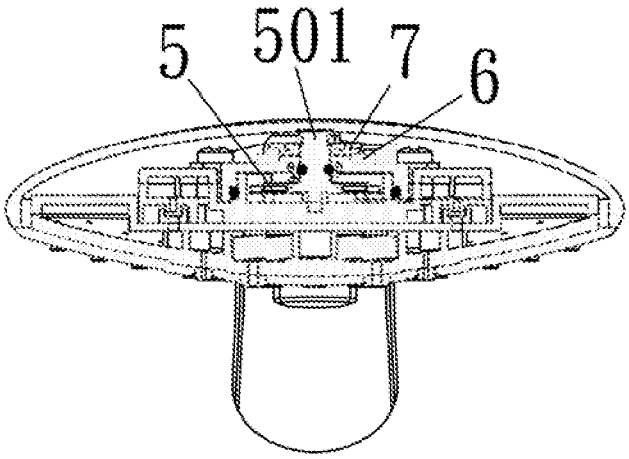
FIG. 7 is a cross sectional view taken from line A-A of FIG. 6.

From the showing of FIGS. 5, 6 and 7, it is noted that when the front pushbutton 401 is manually moved, the rocker 402 is driven to pivot inside the body 1. Because the rocker 402 is connected to a distal end of the sliding element 403, movement of the rocker 402 drives the sliding element 403 to move linearly inside the body 1. Again, due to engagement between the rack 4031 of the sliding element 403 and teeth (not numbered) on the peripheral edge of the gear 6, the linear movement of the sliding element 403 drives the gear 6 to rotate as well. Because the secure engagement between the wolf teeth 8 and the slanted teeth 601 of the gear 6, the movement of the gear 6 as well as the rotor 7 drives the diverter 5 to change its angular position, i.e., to rotate, which results in that the water output pattern changes. While the recoil force from the recoil spring 10 is pulling the sliding element 403 back to its original position, the slanted teeth 601 on the side face of the gear 6 allows the gear 6 to rotate but the rotor 7. As the rotor 7 is securely connected to the diverter 5, when the rotor 7 is not moving, the diverter 5 stays still and the water output pattern remains. However, when the operator pushes the front pushbutton 401 again, the previous mechanism starts again and the water is directed to a different output hole in the diverter 5 to form still another output pattern.

When the rear pushbutton 301 is pushed or pressed, the driving rod 302 is accordingly moved by the movement of the rear pushbutton 301. It is noted that due to the mutual relationship between the first ratchet teeth 304*a* and the second ratchet teeth 304*b*, the linear movement of the driving rod 302 drives the diverting element 303 to rotate, which results that the waterway 2 is accordingly and selectively on or off every time the diverting element 303 is rotated.

After a detailed description of the preferred embodiment (s) has been provided, any skilled person in the art would easily understand the description so provided is for example purpose only. The scope for protection of the present invention is defined by the attached claims. Any skilled person in the art would easily amend, modify or alter the elements/devices of the present invention without departing from the principle essence and spirit of the present invention. However, the amendment, modification or alteration shall fall within the protection scope sought of the present invention.

What is claimed is:

1. A shower head comprising:

a body provided with a waterway;

a first switch movably mounted on the body to be responsible for selectively opening and closing the waterway; and a second switch movably mounted on the body to be responsible for selectively changing water output patterns, comprising:

a front pushbutton movable relative to the body;

a sliding element movably received inside the body and having a rack formed on a face thereof;

a diverter rotatably received inside the body;

a gear rotatably received inside the body and having teeth formed on a peripheral edge thereof to engage with the rack of the sliding element to allow linear movement of the sliding element to drive the gear to rotate and first ratchet teeth formed on a side face thereof; and a rotor firmly mounted to the diverter and having second ratchet teeth selectively engaged with the first ratchet teeth to allow the rotation of the gear to drive the second ratchet teeth of the rotor to disengage with the first ratchet teeth of the gear as well as the rotor and the diverter to rotate accordingly.

2. The shower head as claimed in claim 1, wherein the first switch comprises:

a rear pushbutton movable relative to the body;

a driving rod movably connected to the rear pushbutton; and a diverting element movable relative to the body and operably connected to the driving rod to be responsible for closing or opening the waterway.

3. The shower head as claimed in claim 2, wherein the first switch further has a first recoil spring provided between an inner face of the body and a side face of the diverting element to provide a recoil force to the diverting element after the diverting element is moved.

4. The shower head as claimed in claim 3, wherein the driving rod has first ratchet teeth formed on a side face thereof and the diverting element has second ratchet teeth formed on a side face thereof to disengageably connect to the first ratchet teeth to allow the movement of the driving rod to drive the diverting element to rotate accordingly, which opens or closes the waterway of the body.

5. The shower head as claimed in claim 2, wherein the driving rod has first ratchet teeth formed on a side face thereof and the diverting element has second ratchet teeth formed on a side face thereof to disengageably connect to the first ratchet teeth to allow the movement of the driving rod to drive the diverting element to rotate accordingly, which opens or closes the waterway of the body.

6. The shower head as claimed in claim 1 further comprising a recoil spring provided between an inner face of the body and a distal end of the sliding element to provide a recoil force to the sliding element after the sliding element is moved.

7. The shower head as claimed in claim 6, wherein the driving rod has first ratchet teeth formed on a side face thereof and the diverting element has second ratchet teeth formed on a side face thereof to disengageably connect to the first ratchet teeth to allow the movement of the driving rod to drive the diverting element to rotate accordingly, which opens or closes the waterway of the body.

8. The shower head as claimed in claim 7, wherein the second switch further has a second recoil spring provided between an inner face of the body and a side face of the rotor to provide a recoil force to the rotor after the rotor is moved.

9. The shower head as claimed in claim 6, wherein the second switch further has a second recoil spring provided between an inner face of the body and a side face of the rotor to provide a recoil force to the rotor after the rotor is moved.

10. The shower head as claimed in claim 1, wherein the driving rod has first ratchet teeth formed on a side face thereof and the diverting element has second ratchet teeth formed on a side face thereof to disengageably connect to the first ratchet teeth to allow the movement of the driving rod to drive the diverting element to rotate accordingly, which opens or closes the waterway of the body.

11. The shower head as claimed in claim 10, wherein the second switch further has a second recoil spring provided between an inner face of the body and a side face of the rotor to provide a recoil force to the rotor after the rotor is moved.

12. The shower head as claimed in claim 1, wherein the second switch further has a second recoil spring provided between an inner face of the body and a side face of the rotor to provide a recoil force to the rotor after the rotor is moved.

* * * * *